US007104031B2

(12) United States Patent
Baggot et al.

(10) Patent No.: US 7,104,031 B2
(45) Date of Patent: Sep. 12, 2006

(54) VARIABLE POSITION CONSTANT FORCE PACKAGING SYSTEM AND PROCESS FOR USING SAME

(75) Inventors: James Leo Baggot, Menasha, WI (US); Michael Earl Daniels, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 25 days.

(21) Appl. No.: 11/017,626

(22) Filed: Dec. 20, 2004

(65) Prior Publication Data

US 2006/0130431 A1 Jun. 22, 2006

(51) Int. Cl.
*B65B 57/00* (2006.01)
*B65B 63/02* (2006.01)

(52) U.S. Cl. ..... 53/439; 53/443; 53/450; 53/52; 53/77; 53/530; 53/547; 53/550; 73/824

(58) Field of Classification Search ..... 53/438, 53/439, 443, 450, 52, 77, 530, 547, 550; 73/818, 824; 100/48
See application file for complete search history.

(56) References Cited

U.S. PATENT DOCUMENTS

| | | | | |
|---|---|---|---|---|
| 3,540,270 | A | 11/1970 | Wolfer | |
| 3,822,588 | A | 7/1974 | Knight et al. | |
| 3,949,537 | A | 4/1976 | Jason et al. | |
| 3,958,390 | A | 5/1976 | Pringle, Jr. et al. | |
| 4,159,760 | A | 7/1979 | Kovacs et al. | |
| 4,430,844 | A | 2/1984 | James | |
| 4,594,880 | A | 6/1986 | Murdoch et al. | |
| 4,676,094 | A | 6/1987 | Hoffmann et al. | |
| 4,679,379 | A * | 7/1987 | Cassoli | 53/438 |
| 4,765,474 | A | 8/1988 | James | |
| 4,858,416 | A * | 8/1989 | Monaghan | 53/439 |
| 4,866,984 | A | 9/1989 | Houghton | |
| 4,875,328 | A | 10/1989 | Meyer | |
| 4,883,233 | A | 11/1989 | Saukkonen et al. | |
| 4,970,895 | A | 11/1990 | Houghton et al. | |
| 5,079,728 | A | 1/1992 | Adams et al. | |

(Continued)

FOREIGN PATENT DOCUMENTS

| | | |
|---|---|---|
| WO | WO9724595 A1 | 7/1997 |

OTHER PUBLICATIONS

U.S. Appl. No. 10/704,384, filed Nov. 7, 2003, Sartain et al.

(Continued)

*Primary Examiner*—Stephen F. Gerrity
(74) *Attorney, Agent, or Firm*—Dority & Manning, P.A.

(57) ABSTRACT

A packaging process line that compacts rolled products as they are packaged is disclosed. A firmness measuring device is used to measure the firmness of the rolls as the rolls, for instance, enter the process line. The roll firmness device is placed in communication with a controller, such as a microprocessor. The microprocessor is configured to receive information from the roll firmness device and control one or more elements within the process line that apply a compressive force to the rolls. In particular, the controller is configured to adjust any packaging equipment that applies a compressive force to the rolls so that a substantially uniform amount of force is applied to the rolls throughout the system. In this manner, the system is capable of automatically making adjustments based upon any variation in the product. Misfeeds, miscounts and the like are minimized for improving process efficiency and minimizing process downtime. Fully automatic grade changes can also be achieved with this information and control.

44 Claims, 5 Drawing Sheets

U.S. PATENT DOCUMENTS

| | | | | |
|---|---|---|---|---|
| 5,150,850 | A | | 9/1992 | Adams |
| 5,195,300 | A | | 3/1993 | Kovacs et al. |
| 5,228,273 | A | | 7/1993 | Kovacs |
| 5,282,382 | A | | 2/1994 | Fiore et al. |
| 5,301,793 | A | | 4/1994 | Kovacs |
| 5,356,364 | A | * | 10/1994 | Veith et al. ..... 493/395 |
| 5,402,673 | A | | 4/1995 | Weinert et al. |
| 5,433,063 | A | | 7/1995 | Kovacs et al. |
| 5,437,417 | A | | 8/1995 | Kammann |
| 5,473,862 | A | * | 12/1995 | Brizzi et al. ..... 53/447 |
| 5,531,101 | A | * | 7/1996 | Fenlon ..... 73/49.3 |
| 6,077,590 | A | | 6/2000 | Archer et al. |
| 6,098,371 | A | | 8/2000 | Cassoli et al. |
| 6,161,678 | A | | 12/2000 | Cassoli et al. |
| 6,308,497 | B1 | | 10/2001 | Cassoli et al. |
| 6,494,399 | B1 | | 12/2002 | Rautakorpi |
| 6,684,610 | B1 | | 2/2004 | Gorrieri et al. |
| 6,684,611 | B1 | | 2/2004 | Cassoli |
| 6,718,728 | B1 | | 4/2004 | Antoniazzi et al. |
| 6,755,940 | B1 | | 6/2004 | Lin et al. |
| 2003/0115773 | A1 | | 6/2003 | Lin et al. |
| 2003/0231318 | A1 | | 12/2003 | Sartain et al. |
| 2004/0068966 | A1 | | 4/2004 | Haasi |
| 2005/0097966 | A1 | * | 5/2005 | Sartain et al. ..... 73/818 |

OTHER PUBLICATIONS

European Search Report for EP 04256653.9, Feb. 18, 2005.

Search Report and Written Opinion for PCT/2005/025568, Nov. 18, 2005.

* cited by examiner

VARIABLE POSITION CONSTANT FORCE PACKAGING SYSTEM AND PROCESS FOR USING SAME

BACKGROUND OF THE INVENTION

Many tissue products, such as toilet paper and paper towels, are typically formed into large supply rolls after being manufactured. After the supply rolls are formed, the rolls are rewound into smaller sized rolls, which are generally more useful for commercial purposes. For example, in many conventional processes, the tissue product is wound onto a hollow cylindrical core made of paper stock during a winding and converting operation.

Once formed into smaller rolls, the rolls of material are then typically fed to a packaging line and packaged in groups such as by being encased in a plastic film. The packaged groups are then placed in boxes or poly bundles and shipped to customers.

In one embodiment, for example, the packaging equipment may include an in-feed conveyor and a sorter for placing the rolls of material into groups of a desired size. The groups are then fed to a forming shoulder where the groups are placed in a tube formed from a plastic packaging film. The film is longitudinally sealed and advanced with the entrained product to a separating apparatus. At the separating apparatus, the tube is periodically severed into individual packages. The open ends of the packages are then folded and sealed and the packages are stacked in boxes. One embodiment of an exemplary packaging line as described above is disclosed in U.S. Pat. No. 5,195,300, which is incorporated herein by reference.

As the rolls of material are packaged, the rolls are typically periodically compressed in order to control the movement of the packages and their processing in the wrapper in order to form properly grouped and separated packages with good tightness.

One problem encountered in conventional packaging equipment, however, is that the equipment is not capable of automatically adjusting to variations in the size and firmness of the product. For example, the product size and firmness can change due to inconsistencies during production and converting of the rolls. Size changes also occur as different products are being packaged. Instead of allowing for size and firmness variations, packaging equipment typically runs at a fixed position. Thus, size and firmness changes of the product cause changes in the amount of compressive force applied to the product allowing for wrapper plug-ups and roll misfeeds. Such problem areas can cause machine downtime and production inefficiencies. Further, in order to implement a grade change, many packaging lines must be shut down and adjusted manually for an extended period of time in order to accommodate the new products.

SUMMARY OF THE INVENTION

In order to address the above problems, the present disclosure is generally directed to an improved system and process for packaging rolls of material. The system applies compressive forces to rolls of material, such as tissue products, while the products are being packaged in order to control the flow of the rolls and packages through the equipment in a controlled and consistent manner in order to run efficiently. In accordance with the present invention, the system monitors the firmness and optionally also the size of the products entering the processing line and makes automatic adjustments for applying consistent forces to the products even as the firmness and size of the products change. By maintaining a consistent force on the products, less misfeeds are likely to occur. Packages produced by the system and process of the present invention are not only tightly constructed but may also be more uniform. In one embodiment, the packaging system of the present invention may be configured to automatically adjust to grade changes for further reducing machine downtime.

In one particular embodiment, for example, the present invention is directed to a system for packaging rolls of material that comprises a process line containing at least one compression inducing element for applying a compressive force to the rolls of material while the rolls of material are being conveyed down the processing line. A firmness measuring device is provided for measuring the firmness of the rolls of material. The firmness measuring device may also be configured to measure the diameter of the rolls.

The system may further include a controller in communication with the firmness measuring device and the compression inducing element. The controller may be configured to control the compression inducing element for applying a desired amount of compressive force to the rolls of material based upon information received from the firmness measuring device. The controller may be, for instance, one or more microprocessors that automatically make adjustments to the compression inducing element based upon the firmness of the products entering the process line.

In one embodiment, the process line may include an in-feed section, a wrapping section in which groups of rolls of material are wrapped in a flexible film and a sealing section for sealing the film around the groups to form packages. The system may include a compression inducing element in the in-feed section, in the wrapping section and in the sealing section which are all controlled by the controller.

As used herein, a compression inducing element relates to any device or mechanism that places a compressive force on a single roll, on a group of rolls or on a package as the packages are formed. In one embodiment, for instance, the compression inducing element may comprise a pair of opposing conveyors. The opposing conveyors may be vertically aligned such that one conveyor is over a corresponding conveyor or the conveyors may be horizontally aligned in a side-by-side relationship. The conveyors may move towards and away from each other for applying a compressive force to rolls of material that are conveyed in between the conveyors. The conveyors may move towards and away from each other through the use of a motorized device, such as a servo motor or a stepper motor. In accordance with the present invention, the controller may be configured to control the motorized device based on information received from the firmness measuring device for applying a uniform amount of compression to the rolls of material.

Opposing conveyors that apply compressive force to the rolls of material may be placed at various multiple locations within the system. For example, the conveyors may be part of an in-feed section that comprises a choke belt assembly for initially compressing and metering rolls into the process line. Alternatively, the opposing conveyors may be positioned to assist with wrapping the rolls into a flexible plastic sheet. For example, the opposing conveyors may be part of a package separating device located within a wrapping section of the process line. The package separating device may be configured to separate a first group of wrapped rolls of material from a second group of wrapped rolls of material. The package separating device may include a first set of opposing conveyors positioned downstream from a second set of opposing conveyors. The packages may be conveyed at a greater rate of speed through the first pair of opposing conveyors in comparison to the second pair of opposing conveyors for separating the wrapped groups.

In another embodiment, the opposing conveyors may be part of a pull belt section for pulling or bringing the product through the packaging equipment. Additionally, the conveyors may be used for positioning overhead bucket spacing on reciprocating types of wrappers.

In an alternative embodiment, the compression inducing element may comprise a pair of converging movable side rails that apply a compressive force to the rolls of material and assist in sorting the rolls. According to the present invention, the controller can be configured to move the side rails toward and away from each other based upon information received from the firmness measuring device for applying a substantially constant and uniform compressive force to the rolls of material as they are conveyed.

In still another embodiment of the present invention, the compression inducing element may be incorporated into a forming shoulder or a girth former where the forming shoulder is adjusted by expanding or contracting to apply constant force on a roll or group of rolls entering the forming shoulder. Again, in this manner, the present invention allows for automatic adjustment of the forming shoulder.

The firmness measuring device may also vary depending upon the particular application. For example, in one embodiment, the firmness measuring device may comprise a strain gauge that is incorporated into the compression inducing element.

In an alternative embodiment, the firmness measuring device may be positioned prior to the process line or within the process line and may comprise a contact element positioned a predetermined distance from a support surface. The predetermined distance may be such that the contact element contacts a roll of material when the roll of material is supported by the support surface. A force sensing device, such as a load cell, may be present for measuring the amount of force exerted against the contact element when a roll of material is placed in between the contact element and the support surface. The position or the reading of the force sensor when a roll of material is placed in contact with the contact element is then used to adjust the position of various components in the packaging equipment in order to produce a constant force on the package and/or rolls of material. In this embodiment, the position of the components are varied depending upon the firmness or compressive modulus of the product.

In still another embodiment, the firmness measuring device may comprise a contact element positioned at an engagement position. The engagement position is a predetermined distance from the support surface. The predetermined distance is such that the contact element contacts a roll of material when the roll of material is supported by the support surface. The contact element applies a predetermined amount of force against the roll of material. The contact element is also movable away from the support surface when a force is exerted on the contact element that is greater than the predetermined amount of force exerted on the roll of material. The firmness measuring device, in this embodiment, may further comprise a displacement measuring device for measuring a displacement of the contact element from the engagement position to a final position when a roll of material is placed in between the contact element and the support surface.

The firmness measuring device, in various embodiments, may further include a diameter measuring device for measuring the diameter of the rolls of material as they are conveyed.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
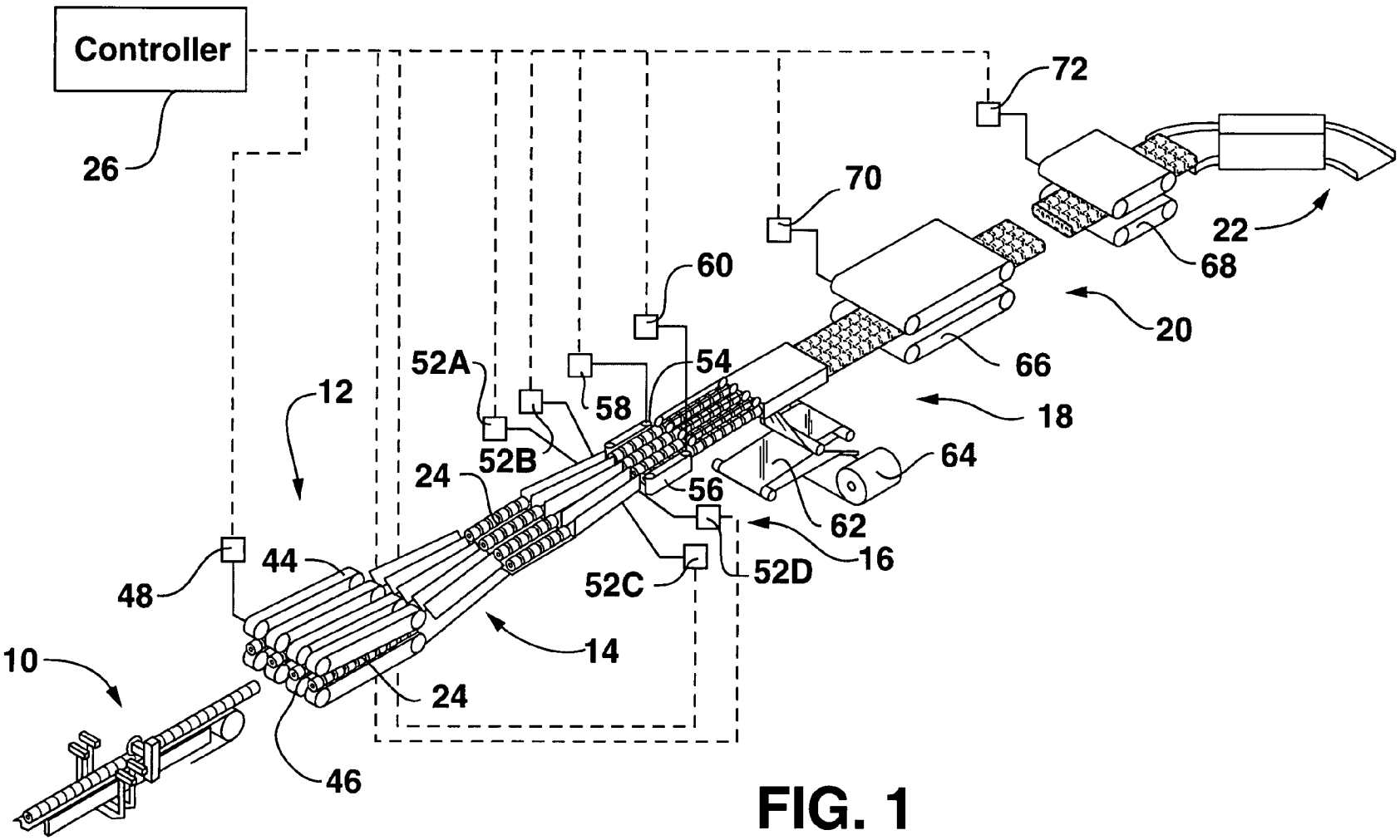
FIG. 1 is a perspective view of one embodiment of a system for packaging rolls of material made in accordance with the present invention.

Repeated use of reference characters in the present specification and drawings is intended to represent the same or analogous features or elements of the present invention.

DETAILED DESCRIPTION OF THE INVENTION

It is to be understood by one of ordinary skill in the art that the present discussion is a description of exemplary embodiments only, and is not intended as limiting the broader aspects of the present invention.

In general, the present invention is directed to a process and system for packaging rolls of material, such as spirally wound paper products or stacked products. More particularly, the wound products may include facial tissues, bath tissues, paper towels, wet wipes, industrial wipers, and the like. Stacked products that may be packaged in accordance with the present invention include paper napkins, facial tissues, foam products, and the like. Through the process and system of the present invention, the products are fed to a processing line and compressed so as to minimize any dead space that may be present in the packages that are to be formed and/or to control the flow of a product and the packages through the process line. As the products are compressed, the products are divided into groups and encased within a packaging material, such as a plastic film. Packages are then sealed and can be shipped as is or may be placed into boxes and shipped.

In accordance with the present invention, the system includes a firmness measuring device that generally measures the firmness of the products, such as the rolls of material and optionally the size of the products as they enter the processing line. Based upon the measured firmness, selected elements of the packaging equipment are adjusted so that a substantially constant compressive force is applied to the products as they are packaged within those selected elements. For example, according to the present invention, each section of the packaging process line requiring compressive force to control the package is substantially maintained at a relatively constant level of force. The amount of force applied to the products from section to section may be the same or different depending upon the needs of that particular section. In accordance with the present invention, the amount of compressive force applied to the products within any given section is maintained substantially uniform. In this manner, the system is configured to automatically make adjustments should the firmness and/or size of the products entering the system vary.

The system and process of the present invention provide various advantages and benefits. For example, the system is capable of making automatic adjustments based upon product size and firmness, wherein the adjustments were made manually or not made at all in the past. By maintaining a substantially consistent force on the incoming products, wrapper plug-ups, roll misfeeds or roll slippage through the various wrapper sections is minimized. In addition, the system and process is better equipped to handle the formed packages. Additionally, the system and process of the present invention may also be configured to allow product changes or grade changes to occur with minimal downtime. Grade change or size change time may be minimal, especially in comparison to systems that rely on manual intervention or previous machine settings for making product grade changes. In fact, in one embodiment, the system may be configured to automatically make adjustments as the products or the size of the packages change on the fly without having to shut down the entire process in order to recalibrate the system. Ultimately, systems made according to the present invention have improved efficiency and throughput with less downtime.

Although the principles of the present invention may be incorporated into any suitable packaging or bundling equipment, one exemplary illustration of a packaging line is illustrated in FIG. 1. As shown, in accordance with the present invention, the packaging line first includes a firmness measuring device 10 that measures firmness and optionally the size of rolled products entering the process. The firmness measuring device 10 can measure the firmness of each rolled product as the product is conveyed or, alternatively, may measure the firmness of a selected population.

After the firmness measuring device 10, the process line includes an in-feed section 12 that initially places a compressive force on the rolls of material 24. Next, the rolls of material enter a series of channels and flight bars 14 that facilitate the organization and grouping of the products. The rolled products then enter a roll alignment section 16. Here, the columns of product may be maintained under compression and separated into desired groupings.

After being grouped, the rolls of material are then fed to a forming shoulder and pull belt section 18 where the groups of rolls are initially wrapped in a packaging material, such as a flexible plastic film. For example, in one embodiment, the groups of rolls are introduced into a plastic tube and the tube is longitudinally lap sealed. The partially-packaged product then advances to a separating section 20 where the plastic film is separated at perforation lines for separating the individual packages. During separation, an upstream group of rolls is held by compression and an adjacent downstream group of rolls is held by compression. The downstream group is then accelerated for separating the packages. Once separated, the packages are then conveyed to an end folding and sealing section 22 where the ends of the packages are sealed. Once sealed, the packages may then be loaded into boxes or bundles for shipping to a desired site.

Thus, as described above, compressive forces are periodically applied to the rolls of material throughout the packaging process. In particular, in the embodiment shown in FIG. 1, compressive forces are applied to the rolls of material in the in-feed section 12, optionally in the roll alignment and grouping section 16, in the forming shoulder and pull belt section 18, and in the separating section 20. In accordance with the present invention, the firmness measuring device 10 monitors the firmness of the incoming rolls. Information from the firmness measuring device 10 is then fed to, for instance, a controller 26. The controller 26 receives the information from the firmness measuring device and based on the information is configured to adjust to the various elements within the processing line for ensuring that a substantially constant compressive force is applied to the rolls as the rolls are packaged. For example, controller 26 can be configured to move the conveyors contained in the processing lines towards and away from each other in order to control the amount of compressive force applied to the rolls of material. By maintaining a relatively constant compressive force on the rolls of material within each section of the process line, problems associated with misfeeds and roll clogging are minimized. Further, the formed packages are more uniform and more appealing to the consumer.

The individual elements contained in the process line of FIG. 1 will now be discussed in greater detail starting with firmness measuring device 10, which is more particularly shown in FIG. 3. In general, any suitable firmness measuring device may be used in accordance with the present invention. Of particular significance, however, is that the device 10 is capable of measuring firmness and optionally the diameter of the products instead of only measuring the size of the product. For example, firmness measurements are a much better indicator of how the roll products are to perform and react to the compressive forces that are applied to the products in the package processing line. Merely measuring the size or diameter of the product, on the other hand, is generally insufficient to predict whether the rolls can be successfully conveyed through a compression inducing element such as the pair of opposing in-feed conveyors shown in the in-feed section 12 of FIG. 1.

Figure 3:
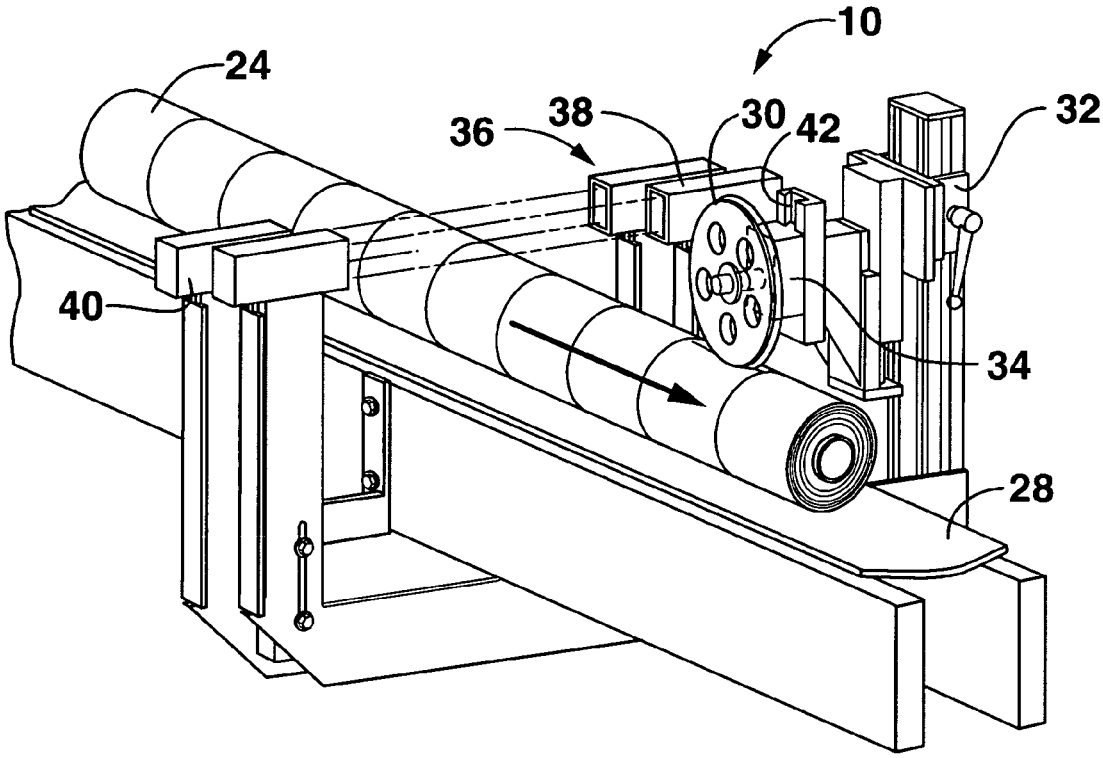
FIG. 3 is a perspective view of one embodiment of a firmness measuring device for use in the present invention.

In the embodiment shown in FIGS. 1 and 3, the firmness measuring device 10 includes a support surface such as a moving conveyor 28 that transports the rolls of material 24. It should be understood, however, that in an alternative embodiment, the support surface may be stationary and the roll firmness device 10 may move into contact with the roll of material. Further, instead of a conveyor, the support surface may comprise, for instance, a mandrel on which the roll is held.

As shown particularly in FIG. 3, the firmness measuring device 10 includes a contact element 30 that contacts the rolls of material 24 as the rolls are conveyed on the support surface 28. The contact element 30 may be, for instance, a wheel or a roller as shown. In other embodiments, however, a stationary shoe may be used that has a low friction surface. The contact element 30 is maintained a particular distance from the support surface or conveyor 28. This distance may be adjusted manually using a brake device 32. It should be understood, however, that any suitable mechanism may be used in order to adjust the position of the contact element.

As the roll of material 24 passes under the contact element 30, the roll 24 exerts a force against the contact element 30. The amount of force placed against the contact element is measured by a force measuring device 34, such as a load cell. The load cell may be, for instance, in one embodiment a strain gauge. The contact element displaces into the roll of material 24 as the roll passes below the contact element. The distance the contact element 30 is displaced into the roll of material 24 depends on the roll firmness and structure of a product. The overall movement of the contact element is dependent upon the diameter of the roll, the height of the contact element and the deflection into the roll.

In one embodiment, by assuming the diameter of the rolls of material 24, the amount of force measured by the force measuring device 34 is directly proportional to the firmness of the rolls. This information can then be sent to the controller 26 as shown in FIG. 1. The controller 26 can be configured to control the equipment in the packaging line based solely on the measurements received from the force measuring device 34.

In an alternative embodiment, the controller 26 may be configured to actually calculate a roll firmness value prior to controlling any of the downstream equipment. For example, from the diameter of the roll of material 24, the distance between the contact element 30 and the conveyor 28, and from the amount of force measured by the load cell 34, a roll firmness value may be calculated.

In one embodiment, for example, a calibration correlation for the roll firmness device prior to use in a process may be programmed into the controller. For example, empirical data may be accumulated and the data can be used to solve the following equation:

$$\frac{1}{\text{Load}} + \frac{1}{\text{Displacement}} + \text{constant} = \text{Roll Firmness.}$$

The above empirical equation can then be plotted for forming a curve. This curve may then be used to evaluate any roll firmness value that is later obtained.

If desired, the roll firmness made by the roll firmness device may be correlated into a Kershaw roll firmness value. In general, roll firmness is normally calculated as the amount of roll deflection in a roll between two force settings. The first force setting is typically a small force setting to make sure there is contact and the second force setting is a larger force setting. The amount of movement between the two force settings correspond to the firmness setting. The Kershaw roll firmness may be calculated in units of distance such as millimeters.

As stated above, when calculating roll firmness, the diameter of the rolls of material may be estimated or assumed. In an alternative embodiment, however, the firmness measuring device 10 may include a diameter measuring device 36 as shown in FIG. 3. In this embodiment, the diameter measuring device 36 includes a pair of focused light sources or lasers 38 and a corresponding pair of light sensors 40 positioned opposite the lasers 38. The lasers 38 emit a curtain of light that is sensed by the light sensors 40. The curtain of light can, for instance, have a width of approximately one inch such as from about 0.8 inches to about 1.2 inches. Further, the curtain of light from each laser is emitted at a particular height with reference to the conveyor 28. When using two lasers as shown in FIG. 3, the lasers may be positioned at different heights in a stepwise manner.

The laser beam that is emitted by the lasers 38 may be non-penetrating beams. Non-penetrating laser beams may be provided, for example, by a gas laser, a solid-state laser, a liquid laser, a chemical laser, a semiconductor laser, and the like.

As shown, when the roll of material 24 is moved on the conveyor 28 adjacent to the diameter measuring device 36, the roll of material intersects the curtains of light being emitted by the lasers 38. Light sensors 40 measure the difference in light intensity caused by the intersection of the light curtains. This information can then be used to determine the diameter of the roll 24. By way of example, the laser beam or beams may have a height of about 24 mm (about 1 inch). Therefore, the diameter of the roll of material is incrementally measurable based on the light sensors 40 receiving from between about 0 to 24 millimeters of the 24 millimeter laser beam. More specifically, a portion of the 24 millimeter laser beam is blocked by the roll of material or log while another portion of the beam is received by the light sensors and converted to the diameter.

Converting the passed-through or received laser beam portion to the diameter is accomplished by the laser assembly which sends, for instance, a 20 milliamp signal to a controller when no portion of the laser beam is being blocked. In other words, the 20 mA signal is produced if the entire 24 mm laser beam is received by the light sensors. Similarly, the laser assembly is configured to send a nominal signal, such as a 4 mA signal to a controller when the laser beam is entirely blocked by the roll of material. Thus, a 4 mA equates to no light being received by the light sensors. In general, the laser beam is adjusted to have a particular height such that half of the beam is blocked when a roll of material at a target diameter is placed on the conveyor. When further rolls of material are placed on the conveyor, the diameter of the roll is determined from the amount of light that is blocked by the roll.

It should be noted that a 4 to 20 milliamp signal, which corresponds to 0 to 24 mm, is by way of example only. For instance, a laser assembly can be provided which uses any suitable milliamp range. Numerous other signal ranges are contemplated to accommodate various lasers from different manufacturers and/or to accommodate specific user requirements.

The diameter measuring device as described above is also disclosed in U.S. patent application Ser. No. 10/172,799 filed on Jun. 14, 2002 to Sartain et al, which is incorporated herein by reference in its entirety.

It should be understood, however, that any suitable diameter measuring device may be used in the system of the present invention. For example, in other embodiments, the diameter measuring device may reflect light off of the top of the roll to measure the diameter of the roll. Optionally, a wheel or roller may make contact with the roll of material for measuring the diameter.

Through the roll firmness device 10 as shown in FIG. 3, roll firmness values may be calculated shortly after the roll of material 24 is formed, allowing for quick or immediate adjustments to be made during the packaging process.

In the embodiment described above, the contact element 30 is placed in a fixed position and a force measuring device 34 measures the amount of force exerted against the contact element when the roll of material is passed below the contact element. In an alternative embodiment of a roll firmness device, however, the contact element may apply a fixed amount of force to a roll of material and may be movable. The amount of movement or displacement of the contact element 30 is then measured in order to calculate the roll firmness.

In this embodiment, contact element 30 is associated with a weight or a force applying device that is capable of applying a predetermined amount of force onto the roll of material 24 as the roll of material traverses below the contact element. As shown in FIG. 3, in one embodiment, the contact element 30 is located within a track 42 that allows the contact element 30 to move away from the roll of material. More particularly, when the roll of material 24 is positioned below the contact element 30, the roll of material causes the contact element 30 to move a distance away from the conveyor 28. This distance is then measured by a displacement measuring device.

The displacement measuring device may be any suitable instrument capable of measuring the displacement of the contact element 30. In one embodiment, for instance, the displacement measuring device may be a potentiometer. Alternatively, a laser may be used to directly measure how much the contact element 30 has displaced into the roll of material 24.

By knowing the diameter of the roll of material 24, the amount of force applied to the roll of material by the contact element 30, and by knowing the amount the contact element displaces when a roll of material is positioned below the contact element, one can calculate a roll firmness value for the roll of material. Similar to the embodiment described above, this roll firmness value may be correlated to a Kershaw roll firmness value if desired.

In this embodiment, the diameter measuring device 36 is also optional. For instance, instead of using a diameter measuring device, the firmness measuring device may estimate or assume the diameter of the rolls.

Thus, in the embodiment described above, a constant force is applied to the roll of material and the displacement of the contact element is measured. The amount of force exerted onto the roll of material 24 by the contact element may be varied as desired. For example, more or less weight may be applied to the contact element. In an alternative embodiment, the contact element may be in operative association with a pneumatic or hydraulic cylinder that applies the predetermined amount of force to the roll of material.

Referring to FIG. 1, when measuring displacement, the displacement information may be sent to the controller 26 for making adjustments in the packaging process line. The controller, for instance, may adjust the packaging equipment based on the displacement data or may be configured first to calculate a roll firmness and then adjust the packaging equipment.

In general, the controller 26 may be any suitable microprocessor, such as a programmable logic unit. Further, it should be understood that the controller 26 may comprise a plurality of microprocessors.

Figure 2:
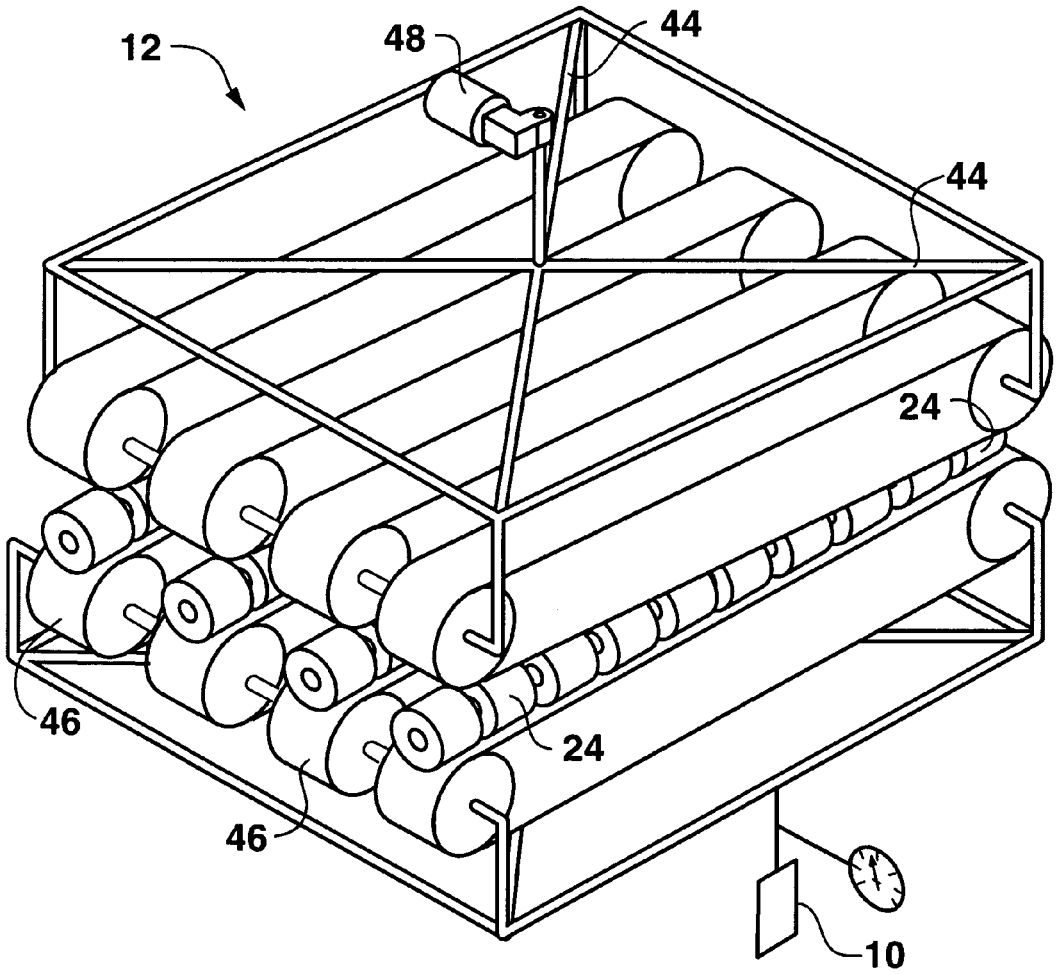
FIG. 2 is a perspective view of one embodiment of an in-feed conveying device for use in the system shown in FIG. 1.

In still another embodiment of the present invention, the firmness measuring device 10 may comprise a strain gauge as shown in FIG. 2. Of particular advantage, when using a strain gauge, the strain gauge can be directly incorporated into the packaging equipment. For example, as shown in FIG. 2, the strain gauge 10 is incorporated into the in-feed section 12. The strain gauge 10, for instance, can measure the amount of strain being placed on the conveyors as the rolls of material 24 are fed through the system. This information can then be fed to the controller 26 for adjusting the distance between the conveyors so that a substantially uniform compressive force is applied to the rolls of material 24. In this embodiment, a single strain gauge may be incorporated into the system. Alternatively, a separate strain gauge may be incorporated into each individual piece of packaging equipment that is configured to apply a compressive force to the rolls. The strain gauges may be used in conjunction with one or more controllers to individually control the equipment together or as separate individual pieces.

Describing the in-feed section 12 in more detail, referring to FIG. 2, the in-feed section in this embodiment comprises a top conveyor 44 and a bottom conveyor 46. The conveyors 44 and 46 are paired, with one pair of the conveyors being provided for each line of product rolls introduced into the process line. The in-feed section 12 as shown in FIG. 2 is also referred to as a choke belt assembly.

In the embodiment illustrated, the in-feed section 12 includes four pairs of conveyors 44 and 46. It should be understood, however, that greater or lesser conveyors may be used. As shown, a column of rolls are fed in between each pair of conveyors 44 and 46. For many applications, the rolls are fed through the infeed section 12 such that the rolls are butted up against each other. In other embodiments, however, the rolls may be slightly spaced apart as shown in FIG. 1.

In order to apply a compressive force to the rolls of material 24, the top conveyor 44 is movable towards and away from the bottom conveyor 46. During processing, the conveyors 44 and 46 apply compression to the rolls of material 24 so as to at least partially collapse the hollow core contained within the rolls. In order to vary the amount of compressive force applied to the rolls of material 24, the in-feed section 12 includes a motorized device 48. In accordance with the present invention, the motorized device 48 is in communication with the controller 26 as shown in FIG. 1. The controller 26 is configured to control the motorized device for varying the distance between the top conveyor 44 and the bottom conveyor 46 based upon information received from the firmness measuring device 10. The motorized device 48 may be, for instance, a servo motor, a stepper motor, or any other suitable device.

Figure 4:
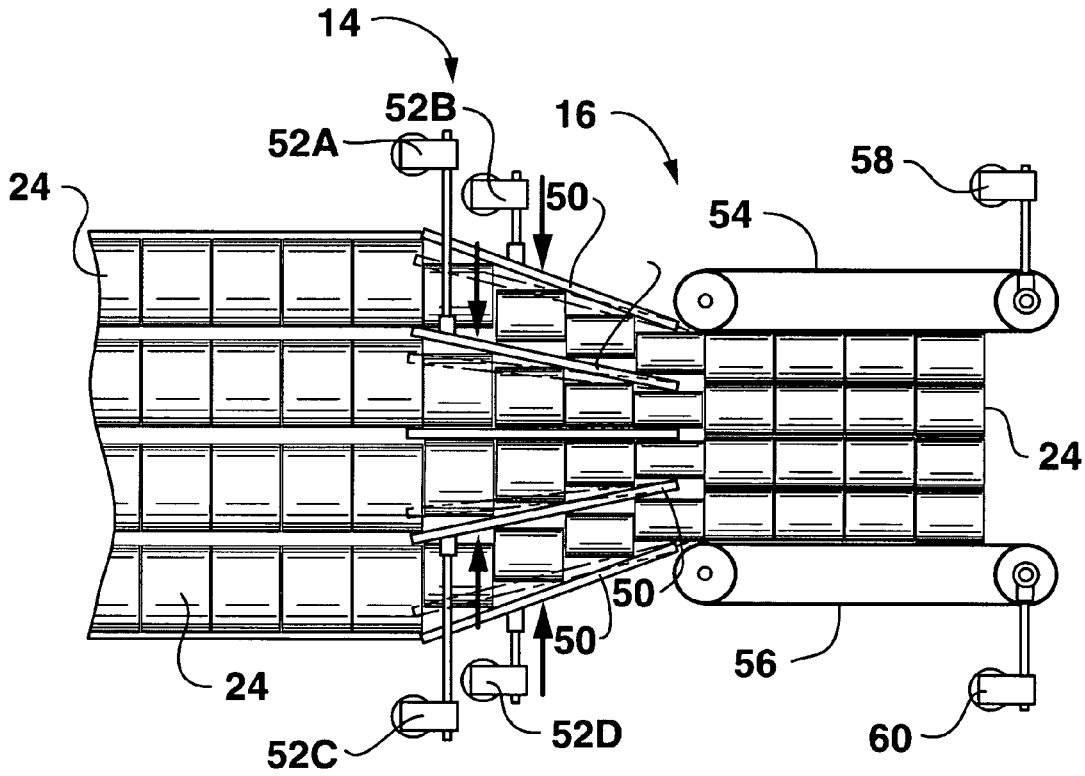
FIG. 4 is an enlarged plan view of a portion of the system illustrated in FIG. 1.

As shown in FIG. 1, from the in-feed section 12, the rolls of material enter a plurality of channels 14 and are then fed to the roll alignment and grouping section 16. The roll alignment and grouping section 16 is more particularly shown in FIG. 4. As illustrated in FIG. 4, the rolls of material 24 may be engaged by a plurality of side rails 50. The side rails 50 not only assist in placing the rolls of material into organized columns but also may apply a compressive force to the rolls. As shown in FIG. 4, the side rails 50 are movable for adjusting the amount of compressive force applied against the rolls. Specifically, the side rails 50 are movable by a plurality of motorized devices 52A, 52B, 52C and 52D. In accordance with the present invention, the motorized devices 52A, 52B, 52C and 52D may be controlled by the controller 26 so as to adjust the position of the rails based upon information received from the firmness measuring device 10.

The roll alignment and grouping section 16 as shown in FIG. 4 may also apply other compressive forces against the rolls of material 24 using, for example, a pair of opposing side conveyors 54 and 56. The side conveyors 54 and 56 are for compacting the columns of rolls prior to being placed in a flexible plastic film.

As shown in FIG. 4, the position of side conveyor 54 is controlled by a motorized device 58 while the position of side conveyor 56 is controlled by a motorized device 60. In accordance with the present invention, the motorized devices 58 and 60 may be controlled by the controller 26 as shown in FIG. 1 in order to adjust the position of the conveyors 54 and 56 to ensure that a uniform amount of compression is being applied to the rolls of material based upon information received from the firmness measuring device 10.

In an alternative embodiment, the roll alignment and grouping section 16, instead of using conveyors, may use side rails that move toward and away from the rolled products.

Figure 5:
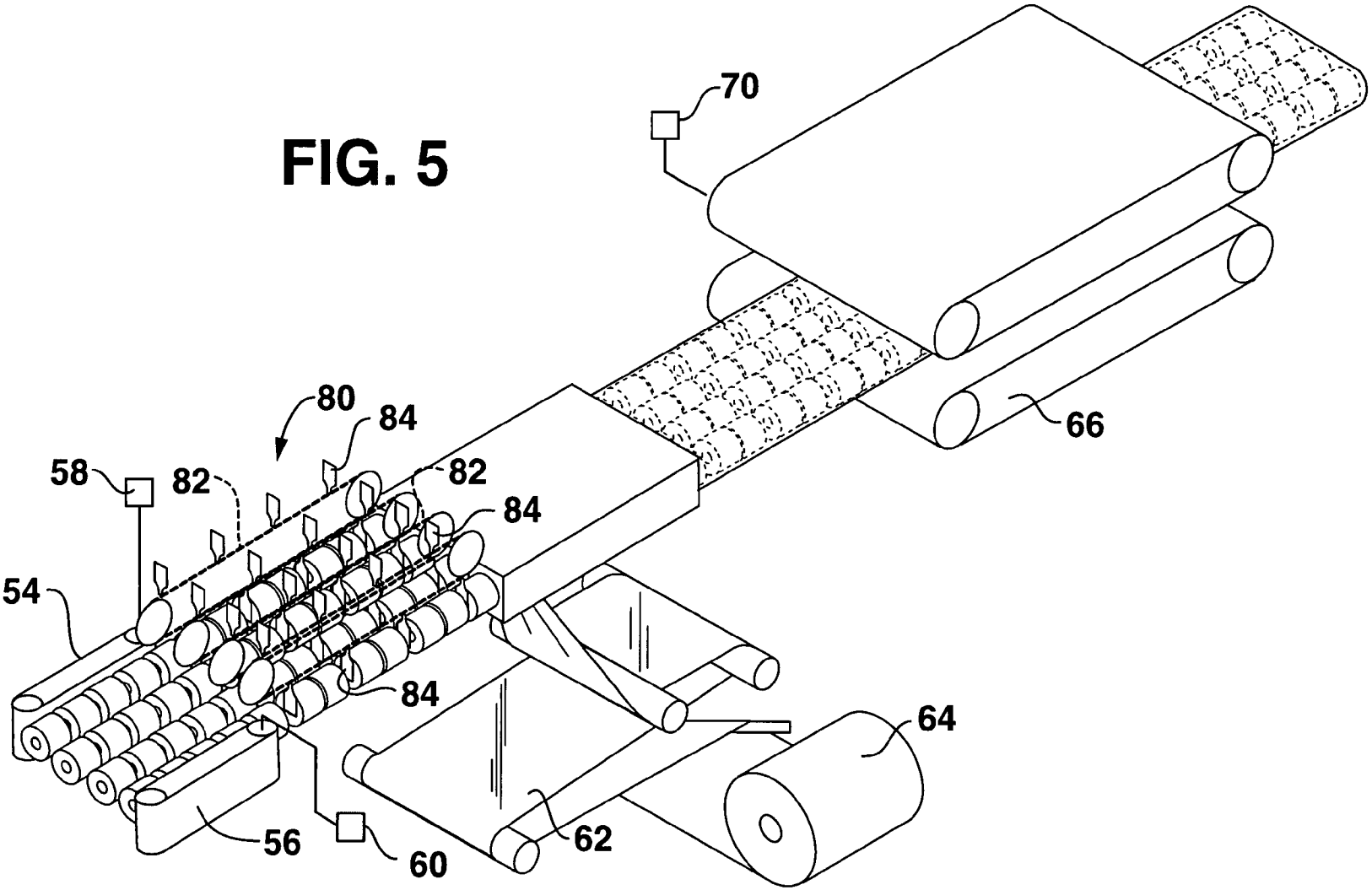
FIG. 5 is a perspective view of one embodiment of a device that may be used to separate rolls of materials into groups for use in the present invention.

From the side conveyors 54 and 56, the rolls of material 24 may be divided into groups using any suitable technique or device known in the art. In one embodiment, for instance, a flight bar and/or overhead pusher generally 80 as shown in FIG. 5 may be used. The overhead pusher 80 not only pushes the rolls of material downstream into a forming shoulder but also is configured to separate the rolls of material into groups.

As shown in FIG. 5, for instance, in this embodiment, the overhead pusher 80 includes a plurality of endless chains 82 that each include a plurality of flights or pushers 84. In this embodiment, the pushers 84 are spaced so as to form product groups containing eight rolls of material. The pushers 84 may be timed to a registration mark on an elongated plastic film 62 to help coordinate the position of the rolls 24 to the forming shoulder section 18.

In the figures, the overhead pusher 80 works in conjunction with the side conveyors 54 and 56. For some applications, the side conveyors 54 and 56 may be optional.

Referring back to FIG. 1, once exiting the roll alignment and grouping section 16, the rolls of material enter the forming shoulder section 18. In the forming shoulder section 18, an elongated plastic film 62 is formed in a conventional fashion into a lapped tube into which the rows of compacted rolls are inserted. To maintain the compaction of the rolls as they enter the lapped tube, the forming shoulder 18 may also include side conveyors or side rails. The position of the side conveyors or side rails may be controlled by the controller 26 as described above with respect to the side conveyors 54 and 56. In one embodiment, a conventional hot air lap sealer may be used to seal overlapping edges of the plastic tube as it progresses through the forming shoulder section 18.

After the forming shoulder 18, the process line may include a pull belt section that assists in pulling the tube of plastic film and the groups of product forward through the wrapper to the separator section. Again, the pull belt section may include a compression inducing element that may be controlled in accordance with the present invention.

If desired, groups of the rolled products exit the forming shoulder in the plastic tube in a spaced fashion. The plastic film 62 forming the tube is fed from a film handling device 64. The film handling device may be conventional and properly tensions the film as the film is wrapped around the rolled products. In addition, the film handling device 64 may also be configured to perforate the film periodically to locate perforations in between the spaced apart groups. The perforations are later employed in the separating section 20 to sever and separate the different packages.

As shown in FIG. 1, the separating section 20 includes a first pair of conveyors 66 and a second pair of conveyors 68 spaced downstream from the first pair of conveyors. The rolls of material are compressed in between the first pair of conveyors 66 and in between the second pair of conveyors 68 as they are conveyed downstream. In order to separate the packages where the perforations have been made, the second pair of conveyors 68 may operate at a faster speed than the first pair of conveyors 66.

As shown, the distance between the first pair of conveyors 66 is controlled by a motorized device 70 while the distance between the second pair of conveyors 68 is controlled by a motorized device 72. In accordance with the present invention, the motorized devices 70 and 72 are controlled by the controller 26 for adjusting the distance between the pair of conveyors 66 and the pair of conveyors 68. In this manner, the distance between the conveyors may be adjusted to ensure that a generally constant compressive force is placed against the products based upon information received from the firmness measuring device 10.

Once exiting the separating section 20, the packages may optionally change direction as shown in FIG. 1 and enter the sealing section 22. In the sealing section 22, the ends of the packages are folded in and sealed. Once fully sealed, the packages containing the compressed rolls 24 may be shipped as is or placed in boxes.

During the entire process as shown in FIG. 1, a single controller 26 may be used to control each of the compression inducing elements that exist along the process line. Separate controllers, however, may be used to separately control each of the compression inducing elements. The controllers may operate in an open loop format or in a closed loop format. In an open loop format, for instance, the controller is set to operate in a predetermined manner and is readjusted should process changes occur in the process line. In a closed loop format, on the other hand, the controller 26 automatically makes adjustments to the compression inducing elements automatically based upon information received from the firmness measuring device.

As stated above, the packaging line illustrated in FIG. 1 represents merely one embodiment of a packaging line designed in accordance with the present invention. Further, it should be understood that the process and system of the present invention may package other products in addition to rolled products. For instance, the process and system of the present invention are particularly well suited to packaging stacked products such as napkins, facial tissue, foam sheets, and the like. Napkins, for instance, are packaged in a very similar manner to the process described above.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for packaging a textile, paper or foam product comprising:

a process line for packaging compressible products, the process line containing at least one compression inducing element for applying a compressive force to the products while the products are being conveyed down the process line;

a firmness measuring device for measuring the firmness of the products; and a controller in communication with the firmness measuring device and the compression inducing element, the controller controlling the compression inducing element in order to maintain a substantially constant compressive force on the products based upon information received from the firmness measuring device.

2. A system as defined in claim 1, wherein the controller is configured to control the compression inducing element for applying a compressive force within preset limits to the products.

3. A system as defined in claim 1, wherein the firmness measuring device comprises a strain gauge.

4. A system as defined in claim 3, wherein the strain gauge is integral with the compression inducing element.

5. A system as defined in claim 1, wherein the firmness measuring device comprises:

a contact element positioned a predetermined distance from a support surface, the predetermined distance being such that the contact element contacts a product when the product is supported by the support surface; and a force sensing device for measuring the amount of force exerted against the contact element when a product is placed in between the contact element and the support surface.

6. A system as defined in claim 5, wherein the products comprise rolls of material and wherein the system further comprising a diameter measuring device for measuring the diameter of a roll of material, the diameter measuring device being in communication with the controller, the controller controlling the compression inducing element based upon information received from the diameter measuring device and the firmness measuring device.

7. A system as defined in claim 5, wherein the force sensing device comprises a load cell.

8. A system as defined in claim 1, wherein the firmness measuring device comprises:

a contact element positioned at an engagement position, the engagement position being a predetermined distance from a support surface, the predetermined distance being such that the contact element contacts a product when the product is supported by the support surface, the contact element applying a predetermined amount of force against the product, the contact element being movable away from the support surface when a force is exerted on the contact element that is greater than the predetermined amount of force exerted on the product; and a displacement measuring device for measuring a displacement of the contact element from the engagement position to a final position when a product is placed in between the contact element and the support surface.

9. A system as defined in claim 8, wherein the products comprise rolls of material and wherein the system further comprising a diameter measuring device for measuring the diameter of a roll of material, the diameter measuring device being in communication with the controller, the controller controlling the compression inducing element based upon information received from the diameter measuring device and the firmness measuring device.

10. A system as defined in claim 1, wherein the controller comprises at least one microprocessor.

11. A system as defined in claim 1, wherein the process line includes at least three compression inducing elements, the controller configured to control all three compression inducing elements based upon information received from the firmness measuring device.

12. A system as defined in claim 1, wherein the compression inducing element comprises a pair of opposing conveyors, the products being conveyed between the opposing conveyors as the compressive force is applied to the products.

13. A system as defined in claim 12, wherein the pair of opposing conveyors comprises a first conveyor positioned below a second conveyor.

14. A system as defined in claim 12, wherein the pair of opposing conveyors are in a side-by-side relationship.

15. A system as defined in claim 12, wherein the compression inducing element further comprises a motorized device that is configured to move the opposing conveyors toward and away from each other, the controller being configured to control the motorized device based on information received from the firmness measuring device.

16. A system as defined in claim 1, wherein the compression inducing element comprises a choke belt assembly.

17. A system as defined in claim 1, wherein the compression inducing element comprises a pair of converging side rails.

18. A system as defined in claim 1, wherein the processing line further comprises a forming shoulder configured to place a group of products into a packaging material.

19. A system as defined in claim 1, wherein the products comprise rolls of material.

20. A system as defined in claim 1, wherein the products comprise napkins.

21. A system as defined in claim 1, wherein the products comprise facial tissues.

22. A system as defined in claim 1, wherein the products comprise foam sheets.

23. A system for packaging rolls of material comprising:

a process line for packaging selected groups of rolls of material into packages, the process line including an in-feed section, a wrapping section where the groups are wrapped in a flexible film and a sealing section for sealing the packages, the process line containing at least one compression inducing element for applying a compressive force to the rolls of material while the rolls of material are being conveyed down the processing line, the compression inducing element including an adjustment device for varying the compressive force applied to the rolls of material;

a firmness measuring device for measuring the firmness of the rolls of material, the firmness measuring device measuring the firmness of a roll of material by applying a force to the rolls; and a controller in communication with the firmness measuring device and the compression inducing element, the controller controlling the adjustment device for maintaining a substantially constant compressive force on the rolls of material based upon information received from the firmness measuring device.

24. A system as defined in claim 23, wherein the compression inducing element comprises a choke belt assembly, the choke belt assembly comprising a pair of opposing conveyors through which the rolls of material are conveyed, the conveyors being movable toward and away from each other in order to increase or decrease the amount of compressive force applied to the rolls of material, the controller being configured to adjust the amount of compressive force applied by the conveyors based on information received from the firmness measuring device.

25. A system as defined in claim 23, wherein the compression inducing element comprises a pair of converging side rails.

26. A system as defined in claim 23, wherein the system comprises a package separating device located within the wrapping section of the process line, the package separating device for separating a first group of wrapped rolls of material from a second group of wrapped rolls of material, the package separating device including a first compression inducing element positioned downstream from a second compression inducing element, the groups of wrapped rolls of material being conveyed at a greater rate of speed through the first compression inducing element than through the second compression inducing element while the compression inducing elements are applying compressive forces for separating the groups of wrapped rolls of material, and wherein the controller is configured to adjust the amount of compressive forces being applied to the groups by the first compression inducing element and by the second compression inducing element based upon information received from the firmness measuring device.

27. A system as defined in claim 23, wherein the firmness measuring device comprises a strain gauge.

28. A system as defined in claim 23, wherein the firmness measuring device comprises:

a contact element positioned a predetermined distance from a support surface, the predetermined distance being such that the contact element contacts a roll of material when the roll of material is supported by the support surface; and a force sensing device for measuring the amount of force exerted against the contact element when a roll of material is placed in between the contact element and the support surface.

29. A system as defined in claim 28, further comprising a diameter measuring device for measuring the diameter of a roll of material, the diameter measuring device being in communication with the controller, the controller controlling the compression inducing element based upon information received from the diameter measuring device and the firmness measuring device.

30. A system as defined in claim 23, wherein the firmness measuring device comprises:

a contact element positioned at an engagement position, the engagement position being a predetermined distance from a support surface, the predetermined distance being such that the contact element contacts a roll of material when the roll of material is supported by the support surface, the contact element applying a predetermined amount of force against the roll of material, the contact element being movable away from the support surface when a force is exerted on the contact element that is greater than the predetermined amount of force exerted on the roll of material; and a displacement measuring device for measuring a displacement of the contact element from the engagement position to a final position when a roll of material is placed in between the contact element and the support surface.

31. A system as defined in claim 30, further comprising a diameter measuring device for measuring the diameter of a roll of material, the diameter measuring device being in communication with the controller, the controller controlling the compression inducing element based upon information received from the diameter measuring device and the firmness measuring device.

32. A system as defined in claim 23, wherein the controller comprises at least one microprocessor.

33. A system as defined in claim 23, wherein the process line includes at least three compression inducing elements, the controller configured to control all three compression inducing elements based upon information received from the firmness measuring device.

34. A process for packaging rolls of material comprising:

conveying rolls of material down a processing line, the processing line sorting the rolls of material into groups, wrapping the groups in a plastic film, and sealing the plastic film to form packages, the processing line applying a compressive force to the rolls of material by a compression inducing element in at least one location while the rolls of material are being conveyed down the processing line;

measuring the firmness of at least some of the rolls of material; and adjusting the compression inducing element so as to maintain a substantially constant compressive force on the rolls of material within each compression inducing element based upon the measured firmness of the rolls of material.

35. A process as defined in claim 34, wherein the firmness of the rolls of material are measured prior to the rolls of material entering the process line.

36. A process as defined in claim 34, wherein the firmness of the rolls of material are measured within the process line.

37. A process as defined in claim 34, wherein the process line includes a plurality of compression inducing elements that each apply a compressive force to the rolls of material, and wherein the process includes the steps of controlling each of the compression inducing elements based upon the firmness measurements.

38. A process as defined in claim 34, wherein the firmness of the rolls of material are measured by:

placing the rolls of material on a support surface; and applying a known load to a surface of the roll of material at a known distance from the support surface.

39. A process as defined in claim 38, wherein the known load is applied to the surface of the rolls of material by a contact element, the contact element being positioned a predetermined distance from the support surface, the predetermined distance being such that the contact element contacts a roll of material when the roll of material is supported by the support surface, and wherein the load is known from a force sensing device that measures the amount of force exerted against the contact element when a roll of material is placed in between the contact element and the support surface.

40. A process as defined in claim 38, wherein the known load applied to the surface of the rolls of material is applied by a contact element positioned at an engagement position a predetermined distance from the support surface, the predetermined distance being such that the contact element contacts the rolls of material when the rolls of material are supported by the support surface, the contact element applying a predetermined amount of force against the rolls of material, the contact element being movable away from the support surface when a force is exerted on the contact element that is greater than the predetermined amount of force exerted on the rolls of material, and wherein a displacement measuring device measures the displacement of the contact element from the engagement position to a final position when the rolls of material are placed in between the contact element and the support surface.

41. A process as defined in claim 34, wherein the rolls of material comprise a paper product.

42. A process as defined in claim 34, wherein the at least one compression inducing element comprises a pair of opposing conveyors that apply a compressive force to the rolls of material, the compressive force being increased or decreased by moving the conveyors towards and away from each other.

43. A process for packaging rolls of material during a product change comprising:

conveying first rolls of material down a processing line, the processing line sorting the first rolls of material into groups, wrapping the groups in a plastic film, and sealing the plastic film to form packages, the processing line applying a compressive force to the first rolls of material by a compression inducing element in at least one location while the first rolls of material are being conveyed down the processing line, the first rolls of material comprising a first product;

changing the product being packaged by conveying second rolls of material down the processing line, the second rolls of material comprising a second product that is different in at least one dimension from the first product;

measuring the firmness of at least some of the second rolls of material;

adjusting the compression inducing element so that the amount of compressive force applied to the first rolls of material is substantially the same as the amount of compressive force applied to the second rolls of material within each compression inducing element based upon the measured firmness of the second rolls of material; and sorting the second rolls of material into groups, wrapping the groups in a plastic film, and sealing the plastic film to form packages.

44. A process as defined in claim 43, wherein the compression inducing element is adjusted automatically by a controller.

* * * * *